United States Patent [19]

Anderson, III et al.

[11] 4,434,411

[45] Feb. 28, 1984

[54] TEMPERATURE-SENSITIVE SWITCH

[75] Inventors: Philip M. Anderson, III, Chatham, N.J.; James E. Kearney, New Hyde Park, N.Y.; Scott E. Gordon, Morristown, N.J.

[73] Assignee: Allied Corporation, Morristown, N.J.

[21] Appl. No.: 356,710

[22] Filed: Mar. 10, 1982

[51] Int. Cl.[3] ..... H01H 61/013

[52] U.S. Cl. ..... 335/208; 335/146

[58] Field of Search ..... 335/208, 146

[56] References Cited

U.S. PATENT DOCUMENTS

| | | | |
|---|---|---|---|
| 1,561,386 | 11/1925 | White . | |
| 1,705,716 | 3/1929 | Claytor . | |
| 1,939,076 | 12/1933 | McShane | 200/88 |
| 2,182,864 | 12/1939 | Frank . | |
| 2,184,372 | 12/1939 | Von Hoorn . | |
| 2,205,944 | 6/1940 | Dunmire . | |
| 2,718,569 | 9/1955 | Johnston | 335/208 |
| 2,781,433 | 2/1957 | Wilckens . | |
| 2,926,227 | 2/1960 | Sundt . | |
| 2,951,927 | 9/1960 | Weller | 219/26 |
| 3,188,448 | 6/1965 | Weller | 219/241 |
| 3,206,573 | 9/1965 | Anderson et al. | 335/146 |
| 3,226,507 | 12/1965 | Kasahara . | |
| 3,287,541 | 11/1966 | Weller | 219/241 |
| 3,290,630 | 12/1966 | Dyksterhouse et al. | 335/146 |
| 3,390,360 | 6/1968 | Umeda | 335/146 |
| 3,453,566 | 7/1969 | Kasahara | 335/16 |
| 3,469,217 | 9/1969 | Linton | 335/208 |
| 3,701,063 | 10/1972 | Clausse | 335/146 |
| 3,743,982 | 7/1973 | Kasahara | 335/208 |
| 4,263,573 | 4/1981 | Melton et al. | 337/140 |
| 4,266,211 | 5/1981 | Ulanet | 335/208 |

FOREIGN PATENT DOCUMENTS 2915737 11/1979 Fed. Rep. of Germany .... 75/123 L

*Primary Examiner*—Harold Broome

*Attorney, Agent, or Firm*—Ernest D. Buff; Gerhard H. Fuchs

[57] ABSTRACT

A temperature-sensitive switch is provided with a resilient movable cantilever composed of amorphous ferromagnetic material having a Curie point. The cantilever is adapted to carry a first contact member. A second contact member is disposed adjacent the first contact member for at least intermittently establishing electrical contact with the first contact member. A magnet is associated with and adapted to bias the cantilever to a first position that establishes electrical continuity between the first and second contact members. The cantilever is transformed from a ferromagnetic phase to a paramagnetic phase when its temperature exceeds the Curie point, whereby the cantilever assumes a second position in which the electrical conductivity is interrupted. The switch is lightweight, compact, economical to manufacture and reliable in operation.

12 Claims, 14 Drawing Figures

TEMPERATURE-SENSITIVE SWITCH

This application is related to the field of temperature-sensing electrical switches. In particular, this invention relates to a thermal switch utilizing the Curie temperature of an amorphous ferromagnetic material to operate the switch.

BACKGROUND OF THE INVENTION

Thermal switches conventionally used to control circuits typically include a laminated bimetallic element, the two materials of which have different thermal coefficients of expansion, so that the bimetallic element moves from one position to another in response to an increase or decrease in ambient temperature. A contact carried by the bimetallic element is thereby moves towards or away from a fixed contact in response to ambient temperature changes to make or break a circuit. The movement is gradual, causing engagement and disengagement between the contacts to be effected too slowly. Contact wear is accelerated and the switch fails prematurely.

To increase the velocity of the movable contact, bimetallic elements have been formed with cut-out sections or with curved cross sections that provide a "snap" action. Such modifications increase the cost of the switch and subject the element to Joule heating, which can adversely alter the characteristics of the bimetal, and hence the accuracy and reliability of the switch. Switch constructions wherein relative movement between the contacts is due in part to temperature characteristics of a magnetic material, such as those taught by U.S. Pat. No. 2,951,927 and 3,287,541, provide contact velocities too slow to prevent contact wear and premature switch failure. For these reasons, temperature-sensitive switches of the type described have resulted in higher purchase and maintenance costs than are considered to be commercially acceptable.

SUMMARY OF THE INVENTION

The present invention provides a temperature-sensitive switch that is lightweight, compact, economical to manufacture and reliable in operation. Generally stated, the switch is mounted on base means that support a resilient movable cantilever composed of amorphous ferromagnetic material having a Curie point. The cantilever is adapted to carry a first contact member. A second contact member is disposed adjacent said first contact member for at least intermittently establishing electrical contact with said first contact member. The first and second contact members are connected to first and second terminal means, respectively. Gripping means support the cantilever and electrically connect it to the first terminal means. Support means are provided for supporting the second terminal means. A magnet means is associated with and adapted to bias the cantilever to a first position that establishes electrical continuity between the first and second contact members. The cantilever is transformed from a ferromagnetic phase to a paramagnetic phase when its temperature exceeds the Curie point, whereby the cantilever assumes a second position in which said electrical continuity is interrupted.

BRIEF DESCRIPTION OF THE DRAWINGS

The invention will be more fully understood and further advantages will become apparent when reference is made to the following detailed description of the preferred embodiments of the invention and the accompanying drawings in which.

DETAILED DESCRIPTION OF THE INVENTION

Figure 1:
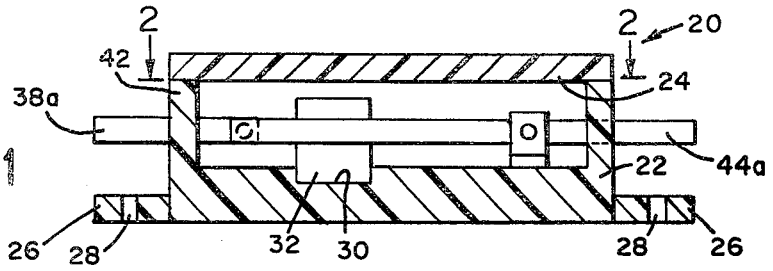
FIG. 1 is a side sectional view of a first embodiment of the invention.
Figure 2:
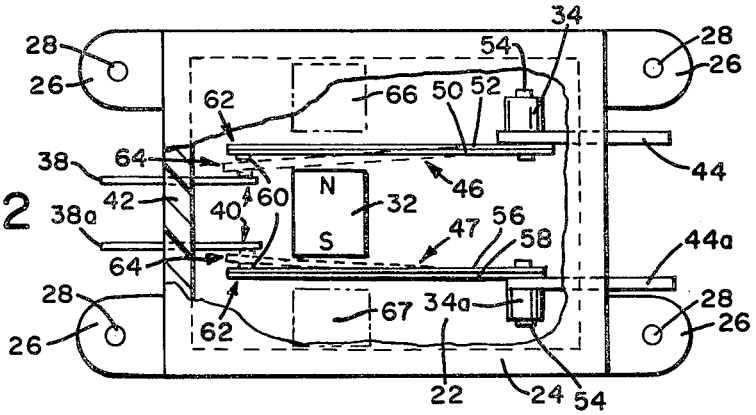
FIG. 2 is a top elevational view of the embodiment of FIG. 1, partially broken away to show the switch structure.

Referring to FIGS. 1 and 2, a dual section thermally-sensitive switch 20 having a base member 22 and a cover member 24 is shown. Base member 22 may be provided with mounting means 26 having mounting holes 28, if desired, although the switch 20 may be adhesively attached to a surface whose temperature is to be monitored or controlled, or, due to its lightness, compactness and simplicity of construction switch 20 may simply be plugged into a conventional socket or connected in-line with conventional quick-connect connectors.

Base member 22 is provided with a pocket 30 or the like for retaining a permanent magnet 32, for providing a magnetic field to attract ferromagnetic amorphous metallic material when it is at a temperature below its Curie point. Switch 20 contains two mirrorimage temperature sensitive switches, usable as a dual flasher, dual circuit breaker, or two-temperature temperature sensing switch. The modifications required to make switch 20 suitable for such uses are well-known in the art, and their precise application will become apparent to one skilled in the art.

As shown, base member 30, preferably of a non-conductive material such as a plastic, includes support members shown as posts 34 and 34*a*, for supporting a resilient movable cantilever and connecting it to a conductive terminal. The resistivity of amorphous metallic materials used herein is relatively high. To avoid localized contact burning, and loss of contact, the amorphous material should not be used directly for electrical termination.

As shown, a pair of terminals, 38, 38*a* are formed as an integral part of contact members 40, 40*a* which extend through upstanding side wall 42 of base member 22. Terminals 38, 38*a* are molded into side wall 42. Alternatively, the terminals can be pressed through or staked to side wall 42, or retained therein by other conventional means. Also, as will be apparent, in some variations and modifications of the invention, it may be desirable to fabricate contact members 40, 40*a* and terminals 38, 38*a* as separate components, electrically connected together.

Posts 34, 34*a* serve as support and connection members between one of a pair of first terminals 44 and at least one resilient movable cantilever, such as 46 or 47. Cantilevers 46 and 47 may be identical, or may be made with amorphous ferromagnetic materials having different Curie temperatures, and may be either a single strip of such material, or a laminated assembly of two or more strips of such an amorphous ferromagnetic material, to increase stiffness, increase ferromagnetic mass, or decrease resistance, in accordance with techniques well-known in the art. Here cantilever 46 is shown as a laminated assembly having two strips of amorphous ferromagnetic material 50 and 52, laminated together, and electrically connected to a first terminal 44 by a gripping or clamping means, here shown as a rivet 54 passing through or adjacent to movable contact member 46 and a first terminal 44, and through post 34, clamping cantilever 46 and first terminal 44 in mechanical and electrical contact. Cantilever 47 is also shown as a laminated member, including strips 56 and 58, gripped or clamped to each other and to a post 34*a* by a rivet 54. Preferably, each cantilever 46 or 47 is fitted with a contact element, to avoid the possibility of contact burning due to the inherent resistivity of amorphous metallic materials, the contact element is attached to cantilever 46 or 47 by forming an aperture therethrough (not shown), and riveting a conventional contact element 60 to a resilient movable cantilever such as 46 or 47 adjacent its respective second contact member 40. Movable cantilevers 46, 47, are biased to a normally open switch position, shown as open position 62, by their own inherent resilience and the positioning of support means, shown as post 34, and attracted to closed position, shown in broken lines as position 64, by attraction to magnet 32 when the amorphous metallic material of movable cantilever 46, 47 is at a temperature below its Curie point. Spring means can, optionally, be employed in the conventional way, to assist the resilience of the cantilevers.

The velocity of the movable cantilevers 46, 47 may be accelerated by bending each of the cantilevers 46, 47 into a curved or V-shaped cross section, or by providing the cantilevers with other conventional modifications that produce a snap-action. Also, magnet 32 may be removed, and magnets placed in positions 66 and 67, shown in phantom lines, and movable contact members 46, 47 biased, such as by bending or by positioning of posts 34, to be inherently urged to close position 64, and pulled to open position 62 by the attraction of a magnet in position 66, 67 when at a temperature below its respective Curie point. Also magnet 32 can be positioned as in FIG. 3 with a flux concentrator 32*a*. Said flux concentrator 32*a* effectively localizes magnet 32 bias to a small area of resilient movable cantilever 46, 47 eliminating effect of temperature variation over cantilever 46, 47.

The amorphous ferromagnetic material of the cantilever is prepared by cooling a melt of the desired composition at a rate of at least about $10^5$° C./sec, employing metal alloy quenching techniques wellknown to the glassy metal alloy art; see, e.g., U.S. Pat. No. 3,856,513 to Chen et al. The purity of all compositions is that found in normal commercial practice.

A variety of techniques are available for fabricating continuous ribbon, wire, sheet, etc. Typically, a particular composition is selected, powders or granules of the requisite elements in the desired portions are melted and homogenized, and the molten alloy is rapidly quenched on a chill surface, such as a rapidly rotating metal cylinder.

Under these quenching conditions, a metastable, homogeneous, ductile material is obtained. The metastable material may be glassy, in which case there is no long-range order. X-ray diffraction patterns of glassy metal alloys show only a diffuse halo, similar to that observed for inorganic oxide glasses. Such glassy alloys must be at least 50% glassy to be sufficiently ductile to permit subsequent handling, such as stamping the cantilever from ribbons of the alloys without degradation of the cantilever's ferromagnetic properties. Preferably, the glassy metal cantilever must be at least 80% glassy to attain superior ductility.

By homogeneous is meant that the material, as produced, is of substantially uniform compositions in all dimensions. By ductile is meant that the cantilever material can be bent to a round radius as small as ten times the boil thickness without fracture.

The metastable phase may also be a solid solution of the constituent elements. In the case of the cantilever of which temperature-sensitive switch 10 is comprised, such metastable, solid solution phases are not ordinarily produced under conventional processing techniques employed in the art of fabricating crystalline alloys. X-ray diffraction patterns of the solid solution alloys show the sharp diffraction peaks characteristic of crystalline alloys, with some broadening of the peaks due to desired fine-grained size of crystallites. Such metastable materials are also ductile when produced under the conditions described above.

Preferably the cantilever material consists essentially of a composition defined by the formula $M_xM_a'Z_y$, where M is one or more metals selected from the group consisting of Fe and Co; M' is one or more alloying metals selected from the group consisting of Ni, Ti, V, Cr, Mn, Zr, Nb, Mo, Hf, Ta, W, Zn, Al and Cu; Z is one or more metalloid elements selected from the group consisting of B, Si, C, and P; x, a and y are in atomic percent and range from about 70–85, 0–12 and 15–30, and the sum x+a+y equals 100.

Amorphous alloys especially suited for use as the cantilever material are defined by the formula $Fe_xNi_{73-x}Mo_4B_{11}Si_{12}$, where subscripts are in atom percent and x ranges from 16 to 100.

It has been found that the Curie temperature of such a composition changes approximately 10 C.° (18 F.°) for each one percent change in the amount of iron therein.

For instance the composition $Fe_{16}Ni_{57}Mo_4B_{11}Si_{12}$ has Curie temperature −96° C. (−141° F.), $Fe_{27}Ni_{46}Mo_4B_{11}Si_{12}$ has a Curie temperature of 32° C. (87° F.), $Fe_{33}Ni_{40}Mo_4B_{11}Si_{12}$ has a Curie temperature of 96° C. (206° F.) and $Fe_{36}Ni_{37}Mo_4B_{11}Si_{12}$ has a Curie temperature of 138° C. (280° F.). The Curie temperatures of five suitable three-component alloys having approximately 80 percent of iron and molybdenum and approximately 20 percent of boron are set forth below.

| Alloy | Curie Temperature (°C.) |
|---|---|
| $Fe_{74}Mo_7B_{19}$ | 145 |
| $Fe_{72.5}Mo_{7.5}B_{20}$ | 150 |
| $Fe_{75}Mo_{5.5}B_{19.5}$ | 180 |
| $Fe_{76}Mo_4B_{20}$ | 195 |
| $Fe_{78}Mo_{3.5}B_{18.5}$ | 235 |

Embodiments of switch 20 incorporating these amorphous metallic alloys require insulating and support materials such as alkyd plastic or other similar electrical insulating material capable of withstanding high temperatures.

Figure 3:
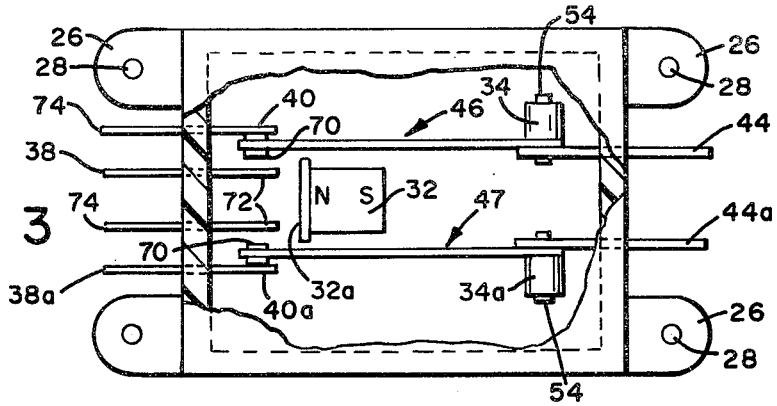
FIG. 3 is a top elevational view of a second embodiment of the invention, partially broken away to show the internal structure.

Referring FIG. 3, a modification of the invention of FIGS. 1 and 2 is shown, in which cantilevers 46 and 47 are composed of a single strip of amorphous metallic material having a Curie point, each being provided with a dual contact element to cooperate with second contact members 40 and 72, shown having terminal portions 38 and 74, respectively, forming a two-section single pole double throw temperature-sensitive switch. As before, cantilevers 46 and 47 may have similar or dissimilar Curie point temperatures, and are attracted to magnet 32 at temperatures below their respective Curie points, and biased away from magnet 32 by their own resilience, the positioning of support means such as post 34, or a bend in members 46, 47. Thus, when an element 46, 47 is at a temperature below its Curie point, electrical continuity will be established between respective terminal portions 38 and 44, and, when cantilever 46, 47 is raised to a temperature above its respective Curie point, either by ambient heating or by Joule heating from a current flow therethrough, it will move towards its relaxed state and establish electrical continuity between terminals 44 and 74.

Figure 4:
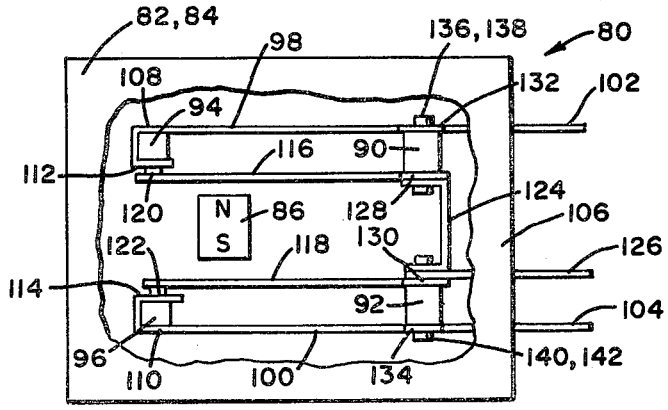
FIG. 4 is a top elevational view of a third embodiment of the invention, partially broken away to show its internal structure.
Figure 5:
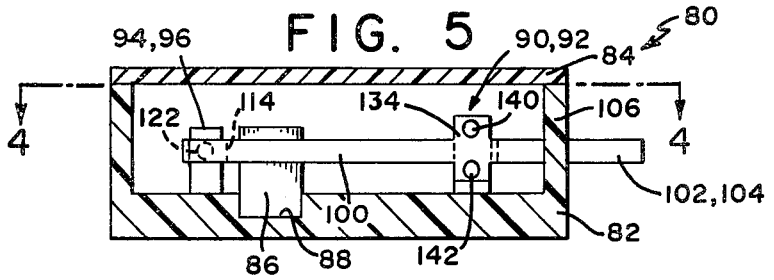
FIG. 5 is a side sectional view of the embodiment of FIG. 4.

FIGS. 4 and 5 show an additional modification requiring only three terminals for a two-section temperature-sensitive switch which is a closed switch when the amorphous metallic material which forms its moving elements is at a temperature above its Curie point. Switch 80 includes a base member 82 and a cover member 84. The base member 82 includes a magnet 86 disposed in a pocket 88 thereof, and which may be retained in pocket 88 by an adhesive or the like. Base member 82 is provided with support projections shown as posts 90, 92, 94 and 96. Support posts 94 and 96 may be eliminated if a terminal arrangement such as is used in FIGS. 1, 2 and 3 is used for the stationary contact members. In the embodiment illustrated, second contact members 98 and 100 have respective terminal portions 102 and 104 extending through side wall 106 of base member 82, and opposite end portions 108 and 110 which are wrapped around posts 94 and 96, respectively, for support against forces imposed by the movable contact members. Second contact members 98 and 100 can, optionally, be made stiff enough to dispense with supports posts 94 and 96. Some flexure of the second contact member enhances wiping or cleaning of the contacts, thereby prolonging the life of the contacts. Second contact members 98 and 100 are preferably made integral with terminal portions 102 and 104, and are made of a low resistivity metallic material. As shown, members 98 and 100 are disposed so as to have areas 112 and 114, respectively, adapted to make contact with a movable contact element. In the embodiment illustrated, resilient movable cantilevers 116 and 118 are provided with contact elements 120 and 122, preferably fastened to cantilevers 116 and 118 by riveting them through an aperture, not shown, in contact members 116 and 118. Contact members 116 and 118 are interconnected by a jumper member 124 extending between posts 90 and 92. Jumper member 124 retains second contact member 98 to post 90, and retains movable contact member 116 to post 90, and retains terminal member 126 to post 90 in electrical contact with resilient movable cantilever 116. Fastening means shown as rivets or welds 130 and 132 retain second contact member 100 to post 92, and retain in stacked fashion movable contact element 118, jumper member 124, and terminal member 126 to post 92, establishing electrical contact between terminal member 126 and movable elements 116 and 118 through jumper member 124.

In the embodiment illustrated in FIGS. 4 and 5, jumper member 124 has perpendicularly bent, widened ends 128 and 130 which are wider than the width of the strip or strips of amorphous metallic material forming movable cantilever 116 and 118, and second contact members 98 and 100 are provided with widened portions 132 and 134, respectively, so that the amorphous metallic material of movable contact members 116 and 118 need not be punctured in order to grip it, rivets 136, 138 and 140, 142, passing on either side of members 116 and 118 and being retained against widened portion 132 and widened end 128 against widened portion 134 and and widened end 130, respectively. This particular construction avoids the necessity to punch or drill an additional aperture in movable cantilever 116 or 118, which may be advantageous since the amorphous nature which provides them with improved magnetic, electrical and mechanical characteristics by eliminating grain boundaries also eliminates fracture lines along which the material can conveniently be shared, resulting in a high rate of wear of drills, punches, dies and the like.

Thus, in the embodiment shown in FIGS. 4 and 5, there will be electrical contact between terminal member 126 and terminal portion 102 when movable cantilever 116 is at a temperature above its Curie point, this contact being broken when member 116 is at a temperature below its Curie temperature, then being attracted to magnet 86 and moving contact 120 away from area 112. Similarly, when movable cantilever 118 is at a temperature above its Curie point, there will be electrical continuity between terminal member 126 and terminal portion 104, which contact will be broken when movable cantilever 118 is at a temperature below its Curie point and attracted to magnet 86, separating contact element 122 from surface 114. Thus, the embodiment of FIGS. 4 and 5 may be used as a dual temperature switch, such as for indicating that a surface to which it is attached is becoming excessively warm, allowing appropriate corrections to be made before a second signal is given disabling the heat-generating source to protect it from damage. In addition, switch 20 can be provided with a multiple switch function in which magnet 86 is long and a series of switching members are disposed side by side so as to be responsive to magnet 86.

Figure 6:
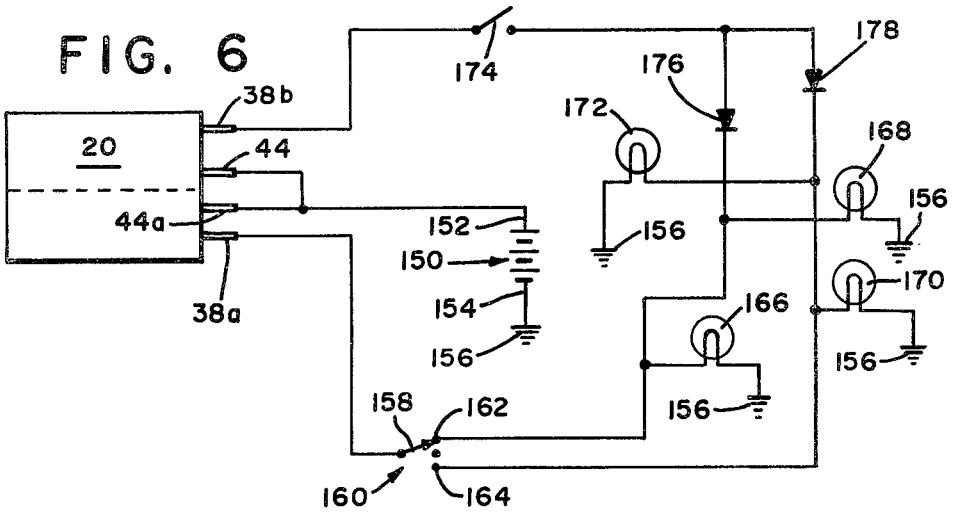
FIG. 6 is a schematic diagram showing a temperature-sensitive switch employed as a dual flasher, such as for automotive turn signals and for hazard warning lights.

FIG. 6 illustrates the embodiment of the invention shown in FIGS. 1 and 2 connected as a dual flasher, such as for turn signals and hazard warning lights on an automotive vehicle. A power supply shown as battery 150 has a first terminal 152 connected to both terminal portions 44, 44*a* of switch 20 and a second terminal 154 connected to ground return 156. A terminal 38*a* is connected to the wiper 158 of a turn signal switch 160, movable to contact a terminal 162 or a terminal 164. When wiper 158 is placed in contact 162, current flows from battery 150, through switch 20 to terminal 38*a*, through switch 160 to lamps 166 and 168, to ground return 156. The resultant heating caused by this current flowing through the amorphous metallic material of movable cantilever 47 connected to terminal 38*a* will cause it to heat to a temperature in excess of its Curie point, causing it to move away from its respective second contact and open the circuit. Once the circuit is opened, the amorphous metallic material will begin to cool, and will again be attracted to magnet 32 to reestablish the current path. If it is desired to closely control relevant on and off times, it would be advisable to insulate the amorphous metallic material of the movable cantilever. If only a portion of the movable cantilever is so insulated, it would be advisable to provide the movable cantilever with a curved or V-shaped cross section to provide a snap-action, since this may affect the timing of the transition of the amorphous metallic material adjacent the magnet through its Curie temperature. Optionally, a flux concentrator can be used to enhance transition sharpness.

When placing wiper 158 of switch 160 is placed on terminal 164, current flows through lamps 170 and 172, to ground return 156, and these lamps, rather than lamps 166 and 168 will flash.

If a hazard warning switch 174 is closed, it is desirable that all lamps 166, 168, 170, 172 flash simultaneously. Since this doubles the current draw, it is desirable to provide an amorphous metallic element with either a different Curie temperature or with a lower total resistance. As shown, a hazard warning switch 174 is connected between terminal 38 of switch 20 and the parallel cathodes of diodes 176 and 178. The anode of diode 176 is connected to lamps 166 and 168, and the anode of diode 178 is connected to lamps 170 and 172, so that current will flow through all lamps 166, 168, 170, 172 to ground return 156 at least intermittently when switch 174 is closed. As before, Joule heating of the amorphous metallic material forming the movable cantilever associated with terminal 38*b* will cause it to reach a temperature above its Curie point, and cause it to cease to be attracted to a magnet, and move away from a second contact, opening the circuit. When the circuit is opened, the movable cantilever cools, and is again attracted to the magnet, forming a flasher, with the rate determined by the rate of heating and cooling the movable cantilever.

Figure 7:
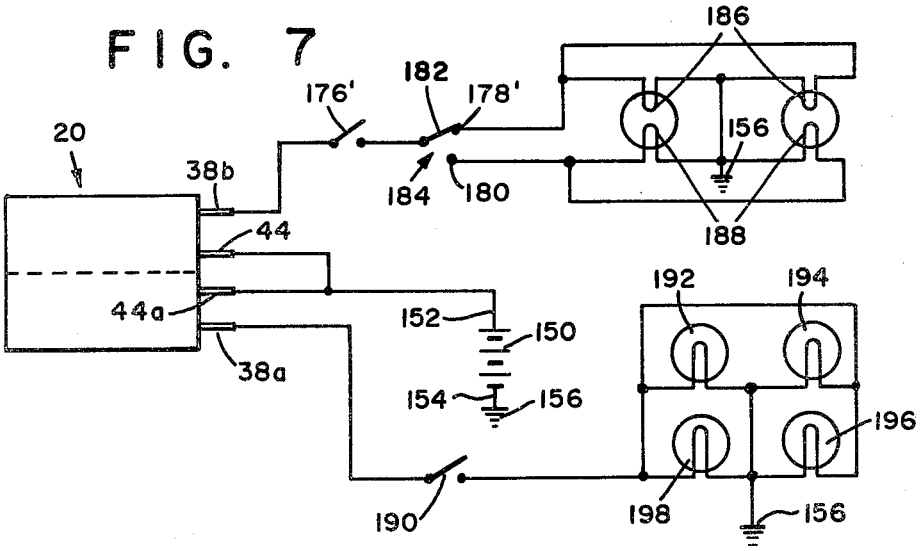
FIG. 7 is a schematic diagram showing a thermally-sensitive switch employed as a dual circuit breaker, such as for automotive headlights and running lights.

FIG. 7 shows switch 20 used as a dual circuit breaker for automotive headlights and running lights. As will be apparent, the difference between a flasher and a circuit breaker is primarily based on selecting a temperature-responsive element that will not be heated to its Curie temperature by normal current flow, and possibly by insulating it to slow its rate of cooling. In the embodiment illustrated, the heating of the small amount of air in the cavity defined between base member 22 and cover member 24 is believed to be adequate to retard the cooling of a temperature-sensitive element according to the invention. Here, current flows from a first terminal 152 of a battery 150, through a first section of dual-section switch through a headlight switch 176', to whichever terminal 178' or 180 is selected by wiper 182 of beam select switch 184. As shown, high beam filaments 186 are connected between terminal 178' and ground return 156, and low beam filaments 188 are connected between 180 and ground return 156. Thus, either filaments 186 or filaments 188 are selected by closing switch 176 and selecting terminal 178 or 180 with wiper 182 of switch 184. Also, current flows from terminal 152 of battery 150 through a second section of switch 20, through a running light switch 190, and through the paralleled combination of running lights 192, 194, 196 and 198 to ground return 156. Thus, a two-section temperature-sensitive switch according to the invention, by proper selection of the resistance of the amorphous metallic material used, such as by varying its width, and placing two movable contacts composed of amorphous metallic material in a housing where they are influenced by a single magnet provides a compact and dependable dual flasher or dual circuit breaker.

Figure 10:
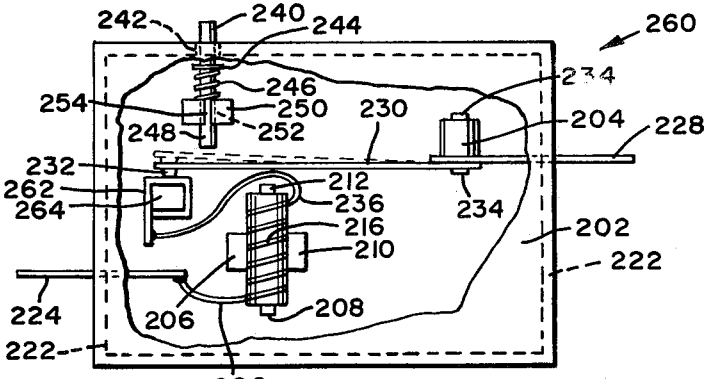
FIG. 10 is a top elevational view of a sixth embodiment of the invention, partially broken away to show internal structure.
Figure 8:
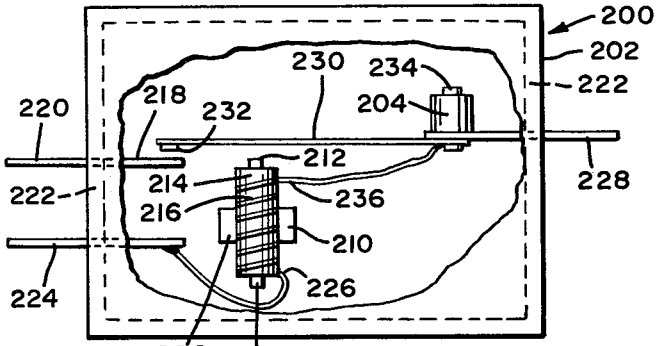
FIG. 8 is a top elevational view of a fourth embodiment of the invention employing an electromagnet, partially broken away to show internal structure thereof.
Figure 9:
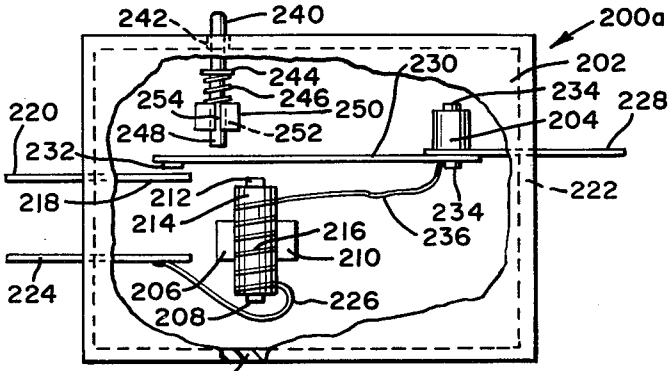
FIG. 9 is a top elevational view of a fifth embodiment of the invention, including manual reset means, partially broken away to show internal structure.

FIGS. 8, 9 and 10 illustrate embodiments of the invention where the magnet means is an electromagnet, applied to a single amorphous metallic movable cantilever as applied to a self-resettable circuit breaker or flasher, or a manually-resettable circuit breaker or flasher. In FIG. 8, a switch 200 has a housing 202 including a support means for a movable contact element and a terminal member shown as post 204, and means for positioning an electromagnet, shown as tab projections 206, 208, 210 and 212. An electromagnet core 214 carrying a winding 216 is fastened to housing 202, either by the tension of tab projections 206, 208, 210 and 212, with or without a retaining adhesive. As illustrated, switch 200 includes a second contact member 218 including an integral terminal portion 220 passing through the side wall 222 of housing 202, and an electromagnet terminal 224 also passing through wall 222. A terminal lead 226 of winding 216 is connected to electromagnet terminal 224. Post 204 supports a terminal member 228, passing through side wall 222, and a movable cantilever 230 formed of a strip of amorphous metallic material having a Curie temperature and provided with a contact element 232 adjacent second contact member 218. A fastening means shown as a rivet 234 attaches terminal member 228 and movable contact member 230 to post 204, and establishes electrical contact between terminal member 228, movable cantilever 230, and terminal lead 236 of winding 216, thus electrically connecting the electromagnet to the movable cantilever. As will be apparent, in order for movable cantilever 130 to make electrical contact with second contact member 218, member 230 must be at a temperature below its Curie point, and the electromagnet winding 216 be energized. As will become further apparent from FIGS. 12–14, this condition may be achieved by connecting terminal 228 to a source of power, terminal 222 to a load, and terminal 224 to a ground return or potential near ground.

FIG. 9 shows a switch 200*a* including manual reset means, for use in circuits where the load must be energized to energize the electromagnet winding, or in the case where the electromagnet coil is connected in series with a high impedance load. As shown in FIG. 9, a push button is provided to manually close the contact between movable cantilever 230 and second contact element 218, to energize an external circuit to provide power to electromagnet winding 216, which will thereafter attract the amorphous magnetic material of movable contact member 230 and maintain the switch in closed position, until movable contact element 230 reaches its Curie temperature. A push rod member 240 is passed through an aperture 242 in side wall 222, fitted with a spring retaining means 244, which may be a C-shaped member resiliently pressed into a groove, not shown, in push rod member 240. A spring 246 is placed over push rod member 240 against spring retaining member 244, and end 248 of push rod member 240 is snapped between halves of a retaining clamp 250 defined by housing 202, having an aperture 252 adapted to receive push rod member 240 and a gap 254 for allowing the sections of retaining clamp 250 to spread apart to receive push rod member 240. When push rod member 240 is depressed, end 248 will contact movable cantilever 230, pushing movable contact member 230 to its closed position. Then, if electromagnet winding 216 is energized, it will be maintained in closed position, assuming that it is at a temperature below its Curie point.

FIG. 10 shows a switch 260 according to the invention having an electromagnet electrically connected in series with the switch, to form a manually-reset circuit breaker. As shown, a second contact member which does not extend to the exterior of switch 260 is provided by bending a strip 262 of conductive contact material to fit around second contact support means shown as post 264, which holds strip 262 in position to be contacted by contact element 232 of movable cantilever 230 when it is attracted by electromagnet winding 216. As in FIG. 9, terminal lead 236 is connected to electromagnet terminal 224, but terminal lead 236 is connected to strip 262, such as by soldering or welding, rather than to movable cantilever 230. Thus, push rod member 240 must be initially activated to close the switch by pushing first contact element 232 of movable cantilever 240 against strip 262, allowing current to flow through the series combination of movable cantilever 230 and electromagnet winding 216. Winding 216 being energized, movable cantilever 230 will be attracted to maintain the switch in closed position until movable cantilever 230 reaches a temperature in excess of its Curie point. At this time, attraction would cease, and the switch would move to its open position and remain in open position until again manually moved to closed position.

Figure 11:
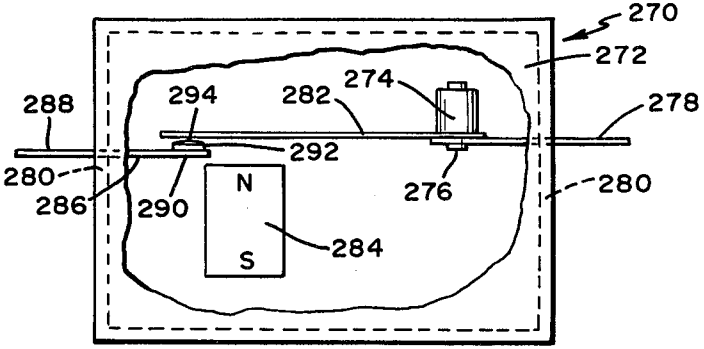
FIG. 11 is a top elevational view of a seventh embodiment of the invention, employing a mercury-wetted contact, partially broken away to show internal structure.

FIG. 11 shows a switch 270 which is similar to one of the two sections of switch 20 shown in FIGS. 1 and 2, but incorporating a mercury-wetted contact to avoid the necessity for making an aperture through the amorphous metallic material to attach a contact element, since it has been found that amorphous metallic materials usable in the instant invention do not absorb mercury. Switch 270 has a housing 272 defining a movable contact member support portion shown as post 274 which, together with one or more fastening means shown as rivets 276 interconnect and support a terminal member 278 passing through side wall 280 of switch 270, and a movable cantilever 282 of an amorphous metallic material having a Curie temperature. Housing 272 also defines means for holding a magnet means, here shown as a permanent magnet 284 disposed adjacent movable contact member 282, for attracting it when it is at a temperature below its Curie point. Second contact member 286 is shown here as having an integral terminal portion 288 extending through side wall 280 of switch 270, and is provided with a mercury-wetted contact element at end 290. As conventional, mercury-wetted contact element 290 includes a head or cup 292 made of or plated with a material which is both wetted by mercury and absorbs mercury, such as gold, in which is placed a small quantity of mercury 294, the quantity being selected in conventional manner to allow the mercury to be retained in position by its surface tension. If the two-rivet retaining arrangement best shown in FIG. 5 is used, a temperature-sensitive switch according to the invention may be made without performing any machining operations on amorphous magnetic material, which is desirable due to the toughness of such materials. Additionally, as previously noted, a flux concentrator may be used.

Figure 12:
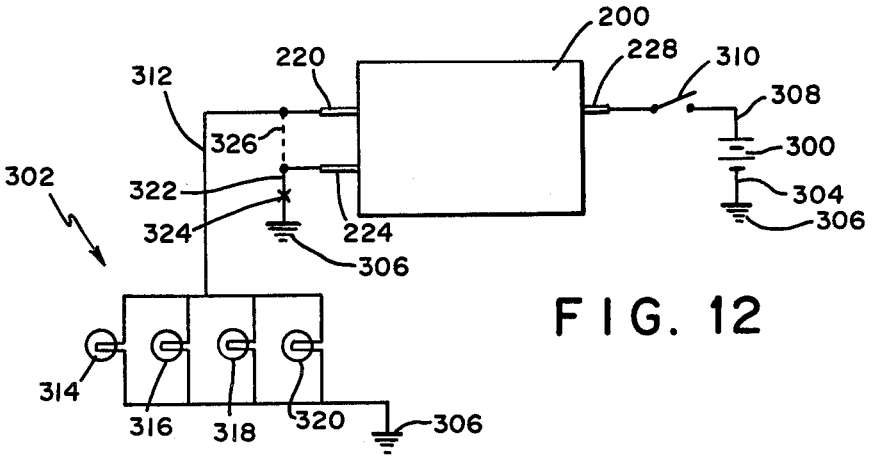
FIG. 12 is a schematic drawing showing the embodiment of FIG. 8 used as a lamp flasher.

Referring now to FIG. 12, a temperature-sensitive switch such as a switch 200 shown in FIG. 8 is interposed between a power source shown as a battery 300 and a load 302 which is of low impedance, at least initially. Battery 300 has a first terminal 304 connected to ground return 306, and a second terminal 308 connected to terminal 228 of switch 200 through a control switch 310. Terminal 220 of switch 200 is connected to load 302 through line 312, load 302 being illustrated as lamps 314, 316, 318 and 320 connected in parallel between line 312 and ground return 306. Terminal 224 of switch 200 may be connected to ground return 306 through line 322, or line 322 may be broken at point 324, as shown, and terminal 224 alternatively connected through line 326 to line 312 and terminal 220. As can be seen by inspection of FIG. 8, when terminal 228 is energized, winding 216 will be fully and continuously energized when terminal 224 is connected to ground return 306, and substantially fully initially energized and subsequently partially energized if terminal 224 is connected to line 312 and terminal 220. As can be seen, in this arrangement, the flashing rate may be determined either by controlling the rate of heating and cooling of the amorphous magnetic material, and by controlling the ratio of impedances between winding 216 and the hot resistance of lamps 314, 316, 318, 320. Also, conventional distortions of the movable cantilever may be used to provide even more rapid switch actuation than obtainable with the use of a flat piece of amorphous magnetic material.

Figure 13:
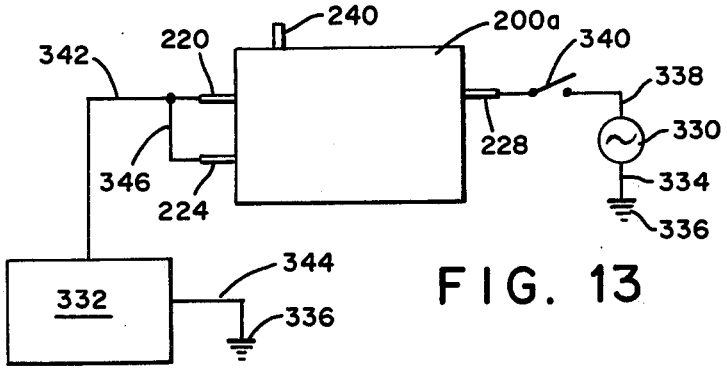
FIG. 13 is a schematic diagram showing the embodiment of FIG. 9 used as a circuit breaker.

FIG. 13 shows a switch such as the modification of switch **200*a* shown in FIG. 9, having push rod member 240. In FIG. 13, switch 200 is shown interposed between a power supply shown as alternating current source 330 and low impedance load 332. As shown, a first terminal 334 of current source 330 is connected to ground return 336, and a second terminal 338 is connected to terminal 228 of switch 200 through a control switch 340. Terminal 220 of switch 200*a* is connected to load 222 through line 342, and is connected to ground return 336 through line 344. A line 346 interconnects electromagnet terminal 224 and terminal 220**.

Thus, in the circuit illustrated, when switch 340 is closed, the movable cantilever will be attracted to the electromagnet if it is at a temperature below its Curie temperature, energizing the load. Upon the occurrence of excessive current, leading to excessive Joule heating, the amorphous material of the movable cantilever will attain a temperature in excess of its Curie point, and cease to be attracted to the electromagnet, opening the circuit through the switch. Push rod 240 may be activated if it is desired to maintain operation of load 332 in spite of excessive current, and may be provided with a conventional cam or bayonet lock, or "push-push" mechanism, to maintain it in depressed position. Of course, the resistance of the movable contact member may be adjusted in view of the impendance of load 332 to act as a flasher, push rod member 240 being used to provide continuous operation of load 332.

Figure 14:
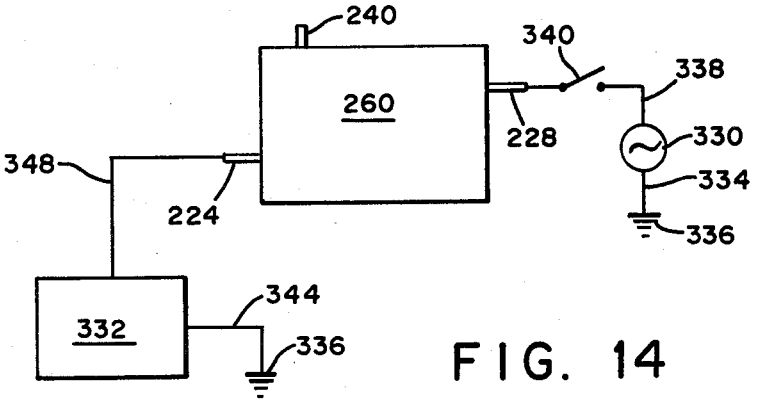
FIG. 14 is a schematic diagram showing the embodiment of FIG. 10 used as a circuit breaker.

FIG. 14 illustrates the function of switch 260, shown in FIG. 10, having an electromagnet electrically connected in series with the movable contact member. Thus, the movable cantilever must be moved to closed position before the electromagnetic winding may be supplied with power to keep it in closed position until its temperature reaches a temperature above its Curie point temperature. Thus, in the circuit of FIG. 14, closing control switch 340 does not result in any activation of load 332. However, when push rod 240 is depressed, contact element 232 of movable cantilever 230 will be urged against the stationary contact formed by strip 262, allowing current to flow through movable cantilever 230, electromagnet winding 216, to terminal 224, and to load 332 through line 348. Thus, switch 260 may be used, for example, as one of a bank of such switches controlling and protecting a number of separate loads supplied with power from a single source, a push rod member 240 being depressed to start the functioning of the load, which functioning will continue either until an overcurrent fault occurs, or until a master switch is opened.

As will be apparent, the numerous features illustrated and discussed may be combined in different arrangements than illustrated, to form numerous versions of a temperature-sensitive switch with a sensing element composed of a current-carrying strip of amorphous metallic material having a Curie temperature which is attracted to operative position by a magnet when it is at a temperature below its Curie point, to produce a simple and dependable temperature-sensitive switch.

Also, a temperature-sensitive switch according to the invention may be used as a "anti-restart" switch, by proper selection of the resistance of the movable cantilever, a push rod member being used to push this member to a closed position, away from the attraction of a magnet, where normal operating current quickly heats the movable cantilever to a temperature above its Curie point temperature, allowing the switch to remain in closed position until current through the load is interrupted, such as by accidental disconnection of the load. This may be accomplished by merely varying the position of the second contact member to an opposite side of the movable cantilever from that illustrated in the several figures, and possibly appropriately bending the movable cantilever so that its resilience will hold it firmly in closed position when it is at a temperature above its Curie point.

Push rod 240 may also be used as an indicator, since it may be pushed outward by the movable cantilever in inoperative position, and the movable cantilever may be wound with insulated resistance wire to hasten its heating, or to allow it to be heated both by ambient temperature and by the operation of an external circuit; or any indirect heater such as a resistor placed adjacent the cantilever member may be used, as is known for bimetallic switches. Further, the shape of the housings disclosed may be varied to fit associated structure in a particular application, and the terminal arrangements may be varied to fit connectors or sockets, as appropriate.

Having thus described the invention in rather full detail, it will be understood that such detail need not be strictly adhered to but that various changes and modifications may suggest themselves to one skilled in the art, all falling within the scope of the invention as defined by the subjoined claims.

We claim:

1. A temperature-sensitive switch, comprising:

base means for mounting said temperature-sensitive switch;

a resilient movable cantilever carrying a first contact member, said cantilever being composed of amorphous ferromagnetic material having a Curie point, wherein said amorphous ferromagnetic material consists essentially of a composition defined by the formula $M_xM'_aZ_y$, where M is at least one metal selected from the group consisting of Fe and Co, M' is at least one alloying metal selected from the group consisting of Ni, Ti, V, Cr, Mn, Zr, Nb, Mo, Hf, Ta, W, Zn, Al, and Cu, Z is at least one metalloid element selected from the group consisting of B, Si, C and P, x, a, and y are in atomic percent and range from about 70–85, 0–12 and 15–30, respectively, and the sum $x+a+y$ equals 100;

a second contact member disposed adjacent said first contact member for at least intermittently establishing electrical contact with said first contact member;

said first contact member being connected to first terminal means, and said second contact member being connected to second terminal means;

gripping means for supporting the cantilever and electrically connecting it to said first terminal means;

support means for supporting said second terminal means; and magnet means associated with and adapted to bias said cantilever to a first position that establishes electrical continuity between said first and second contact members said cantilever being transformed from a ferromagnetic phase to a paramagnetic phase when its temperature exceeds the Curie point, whereby said cantilever assumes a second position in which said electrical continuity is interrupted.

2. A temperature-sensitive switch according to claim 1, wherein said cantilever has said contact member fastened thereto at a location adjacent said second contact member.

3. A temperature-sensitive switch according to claim 2, wherein said second contact member is a mercury-wetted contact element.

4. A temperature-sensitive switch according to claim 1, wherein said magnet is adapted to attract said cantilever and thereby bias the cantilever to said first position.

5. A temperature-sensitive switch according to claim 1, wherein said magnet is adapted to repel said cantilever and thereby bias the cantilever to said first position.

6. A temperature-sensitive switch according to claim 1, wherein said magnet means is a permanent magnet.

7. A temperature-sensitive switch according to claim 1, wherein said magnet means is an electromagnet.

8. A temperature-sensitive switch according to claim 7, wherein said electromagnet has a first winding end electrically connected to said first contact member and a second winding end electrically connected to said second contact member.

9. A temperature-sensitive switch according to claim 7, wherein said switch further comprises third terminal means, and said electromagnet has a first winding end electrically connected to said first contact member and a second winding end electrically connected to said third terminal means.

10. A temperature-sensitive switch according to claim 7, wherein:

(a) said electromagnet is electrically interposed between said fixed contact member and said second terminal; and (b) said electromagnet has a first winding end electrically connected to said second contact member and a second winding end electrically connected to said second terminal means.

11. A temperature-sensitive switch, comprising:

base means for mounting said temperature-sensitive switch;

a resilient movable cantilever carrying a first contact member, said cantilever being composed of amorphous ferromagnetic material having a Curie point, wherein said amorphous ferromagnetic material has a composition defined by the formula $Fe_xNi_{73-x}Mo_4B_{1-1}Si_{12}$, wherein x is in atom percent and ranges from about 15–40.

a second contact member disposed adjacent said first contact member for at least intermittently establishing electrical contact with said first contact member;

said first contact member being connected to first terminal means, and said second contact member being connected to second terminal means;

gripping means for supporting the cantilever and electrically connecting it to said first terminal means;

support means for supporting said second terminal means; and magnet means associated with and adapted to bias said cantilever to a first position that establishes electrical continuity between said first and second contact members said cantilever being transformed from a ferromagnetic phase to a paramagnetic phase when its temperature exceeds the Curie point, whereby said cantilever assumes a second position in which said electrical continuity is interrupted.

12. A temperature-sensitive switch, comprising:

base means for mounting said temperature-sensitive switch;

a resilient movable cantilever carrying a first contact member, said cantilever being composed of amorphous ferromagnetic material having a Curie point, wherein said amorphous ferromagnetic material has a composition defined by the formula $Fe_xMo_yB_z$ wherein x, y, and z are in atom percent and range from about 70–80, 0–10 and 15–25, respectively;

a second contact member disposed adjacent said first contact member for at least intermittently establishing electrical contact with said first contact member;

said first contact member being connected to first terminal means, and said second contact member being connected to second terminal means;

gripping means for supporting the cantilever and electrically connecting it to said first terminal means;

support means for supporting said second terminal means; and magnet means associated with and adapted to bias said cantilever to a first position that establishes electrical continuity between said first and second contact members said cantilever being transformed from a ferromagnetic phase to a paramagnetic phase when its temperature exceeds the Curie point, whereby said cantilever assumes a second position in which said electrical continuity is interrupted.

* * * * *